US011844487B2

(12) United States Patent
Kim et al.

(10) Patent No.: US 11,844,487 B2
(45) Date of Patent: Dec. 19, 2023

(54) VACUUM CLEANER

(71) Applicant: LG Electronics Inc., Seoul (KR)

(72) Inventors: Youngho Kim, Seoul (KR); Myungsig Yoo, Seoul (KR)

(73) Assignee: LG Electronics Inc., Seoul (KR)

( * ) Notice: Subject to any disclaimer, the term of this patent is extended or adjusted under 35 U.S.C. 154(b) by 58 days.

(21) Appl. No.: 17/573,008

(22) Filed: Jan. 11, 2022

(65) Prior Publication Data

US 2022/0125260 A1 Apr. 28, 2022

Related U.S. Application Data

(63) Continuation of application No. 16/628,353, filed as application No. PCT/KR2018/007472 on Jul. 2, 2018, now Pat. No. 11,259,675.

(30) Foreign Application Priority Data

Jul. 4, 2017 (KR) ..... 10-2017-0085067

(51) Int. Cl.

| | |
|---|---|
| ***A47L 9/20*** | (2006.01) |
| ***A47L 5/24*** | (2006.01) |
| ***A47L 9/02*** | (2006.01) |

(52) U.S. Cl.

CPC ..... *A47L 9/20* (2013.01); *A47L 5/24* (2013.01); *A47L 9/02* (2013.01)

(58) Field of Classification Search

CPC ..... A47L 11/40; A47L 9/02; A47L 9/1675; A47L 5/24; A47L 9/20

See application file for complete search history.

(56) References Cited

U.S. PATENT DOCUMENTS 3,465,622 A * 9/1969 Winans ..... B25B 27/0042 81/3.43
4,227,682 A * 10/1980 Ulveling ..... C21B 7/12 266/271

(Continued)

FOREIGN PATENT DOCUMENTS

CN 2126041 12/1992
CN 1127994 7/1996

(Continued)

OTHER PUBLICATIONS

Extended European Search Report in European Appln. No. 18827524.2, dated Feb. 25, 2021, 5 pages.

(Continued)

*Primary Examiner* — Marc Carlson
(74) *Attorney, Agent, or Firm* — Fish & Richardson P.C.

(57) ABSTRACT

A vacuum cleaner includes: a dust canister; a cover rotatably coupled to the dust canister; a filter assembly mounted inside the dust canister and configured to be exposed by an opening of the cover; and a crevice tool coupling to an air entrance of the dust canister or an extension pipe connected to the air entrance. The filter assembly includes an opening portion opened toward the cover, and a protrusion portion protruding from an inner circumferential surface of the opening portion. The crevice tool includes a catching rib caught on the protrusion portion according to insertion and rotation of the crevice tool in the opening portion. The filter assembly is configured to withdraw from the dust canister together with the crevice tool based on withdrawing of the crevice tool to the outside of the dust canister in a state in which the catching rib is caught on the protrusion portion.

8 Claims, 13 Drawing Sheets

(56) References Cited

U.S. PATENT DOCUMENTS

| | | | | |
|---|---|---|---|---|
| 4,951,348 | A * | 8/1990 | Krasznai | A47L 5/24 15/415.1 |
| 8,209,837 | B1 * | 7/2012 | Henshaw | B25B 23/0085 29/283 |
| 8,925,145 | B2 * | 1/2015 | Wilson | A47L 9/1641 15/352 |
| 2020/0214523 | A1 * | 7/2020 | Kim | A47L 11/40 |
| 2020/0260926 | A1 * | 8/2020 | Conrad | A47L 9/2884 |

FOREIGN PATENT DOCUMENTS

| | | |
|---|---|---|
| CN | 1263754 | 8/2000 |
| CN | 1426727 | 7/2003 |
| CN | 1626025 | 6/2005 |
| CN | 1864618 | 11/2006 |
| CN | 1951300 | 4/2007 |
| CN | 102188204 | 9/2011 |
| CN | 202821203 | 3/2013 |
| CN | 202932857 | 5/2013 |
| EP | 1563936 | 8/2005 |
| EP | 1955631 | 8/2008 |
| GB | 139892 | 3/1920 |
| JP | 2003225183 | 8/2003 |
| JP | 2004313745 | 11/2004 |
| JP | 2006340935 | 12/2006 |
| JP | 2009268564 | 11/2009 |
| JP | 2011235185 | 11/2011 |
| JP | 2014068749 | 4/2014 |
| JP | 2016043140 | 4/2016 |
| KR | 1020020009768 | 2/2002 |
| KR | 1020160034041 | 3/2016 |

OTHER PUBLICATIONS

Notice of Allowance in Australian Appln. No. 2018295855, dated Jul. 6, 2021, 4 pages.

Notice of Allowance in Japanese Appln. No. 2019-571683, dated Feb. 16, 2021, 7 pages (with English translation).

Office Action in Chinese Appln. No. 201880043518, dated Dec. 7, 2020, 12 pages.

* cited by examiner

VACUUM CLEANER

CROSS-REFERENCE TO RELATED APPLICATIONS

This application is a continuation of U.S. application Ser. No. 16/628,353, filed on Jan. 3, 2020, which is a National Stage application under 35 U.S.C. § 371 of International Application No. PCT/KR2018/007472, filed on Jul. 2, 2018, which claims the benefit of Korean Application No. 10-2017-0085067, filed on Jul. 4, 2017. The disclosures of the prior applications are incorporated by reference in their entirety.

TECHNICAL FIELD

The present disclosure relates to a cleaner that sucks or wipes dust or foreign substances in a region to be cleaned.

BACKGROUND

A cleaner is an apparatus that suctions dust or foreign materials in a region to be cleaned, together with air, by using suction force generated in a suction motor, separates the dust and foreign materials from the air, collects the dust and foreign materials while discharging the air.

Such cleaners may be classified into a manual cleaner and an automatic cleaner. A manual cleaner performs cleaning while being moved by a user's operation. Manual cleaners may be classified into a canister type, an upright type, a handy type, a stick type, and the like according to a shape. An automatic cleaner performs cleaning based on a Simultaneous Localization and Mapping (SLAM) technology without a user's operation.

Korean Patent Laid-Open Publication No. 10-2016-0034041 (Mar. 29, 2016), which is the Patent Literature, discloses a handy cleaner. The handy cleaner includes a body, a collecting container for collecting dust, and a grill part installed inside the collecting container. The grill part removes dust or foreign materials larger than holes. Therefore, as the handy cleaner is driven for an extended time, dust or foreign substances accumulate on the grill part.

The dust or foreign materials that accumulate on the grill part causes deterioration of a cleaning performance of the handy cleaner. In order to maintain the cleaning performance of the handy cleaner, it is necessary to clean the grill part inside the collecting container of the handy cleaner by opening the collecting container.

However, it is impossible to clean up the dust or foreign materials accumulated on the grill part merely by opening the collecting container and shaking the body. In order to clean up the grill part, it is inevitable to separate the grill part from the body. In this process, if the grill part is gripped by a hand, the dust or foreign substances may be transferred to the user's hand, causing hygienically undesirable effects.

SUMMARY

One aspect of the present disclosure is to provide a cleaner having a structure capable of removing dust or foreign materials accumulated in a body hygienically without touching the dust or foreign materials by hand.

Another aspect of the present disclosure is to provide a cleaner having a structure capable of detaching a component with dust or foreign materials from inside of the cleaner, by using a cleaning tool which is one of accessories of the cleaner.

Still another aspect of the present disclosure is to provide a cleaner having a structure capable of assembling a completely cleaned component back into the cleaner by using a cleaning tool.

In order to achieve those aspects and other advantages of the present disclosure, a cleaner according to an embodiment of the present disclosure may include a dust canister configured to collect dust therein, a filter assembly mounted inside the dust canister, and a crevice tool connectable to an air entrance of the body or an extension pipe connected to the air entrance. The filter assembly may be drawn out of the dust canister together with the crevice tool by a force for pulling the crevice tool out of the dust canister while a locking rib of the crevice tool is locked on a protrusion.

The dust canister may be provided in the body. The cleaner may include a cover rotatably coupled to the body to open and close the dust canister. The filter assembly may be mounted inside the dust canister so as to be exposed when the cover is opened, and may filter dust from air flowing along an inner flow path of the body.

The filter assembly may include an opening opened toward the cover, and a protrusion protruding from an inner circumferential surface of the opening.

The crevice tool may include a locking rib locked on the protrusion as the crevice tool is inserted into the opening and rotated.

The protrusion may be provided in plurality, spaced apart from one another along the inner circumferential surface of the opening. The locking rib may be inserted between two neighboring protrusions by the insertion of the crevice tool, and locked on one of the two protrusions by rotation of the crevice tool.

The locking rib may include a position setting portion extending along a direction that the crevice tool is inserted and drawn out, and a locking portion extending in a direction intersecting with the position setting portion and locked on one of the two protrusions.

The crevice tool may be rotatable in a first direction and a second direction opposite to each other in a state where the crevice tool is inserted into the opening. The first direction may correspond to a direction in which the locking portion is locked by one of the two protrusions, and the second direction may correspond to a direction in which the locking portion is released from the one of the two protrusions.

The position setting portion may be brought into close contact with the one of the two protrusions by the rotation of the crevice tool in the first direction so as to set a locking position of the locking rib. The position setting portion may be brought into close contact with another one of the two protrusions by the rotation of the crevice tool in the second direction so as to set an unlocking position of the locking rib.

The filter assembly may be rotated in the first direction by a force applied further toward the first direction after the position setting portion is brought into close contact with the one of the two protrusions. The filter assembly may be rotated in the second direction by a force applied further toward the second direction after the position setting portion is brought into close contact with the another one of the two protrusions.

The filter assembly may be detached from the inside of the dust canister as it rotates in the first direction, and may be attached to the inside of the dust canister as it rotates in the second direction.

The crevice tool may include a stopper formed on one end of the locking rib. The stopper may protrude from an outer side of the crevice tool and protrude more than the locking rib to set an insertion length of the crevice tool.

The protrusion may be provided in plurality, and arranged along the inner circumferential surface of the opening in a manner that each pair of protrusions faces each other. The locking rib may be provided in plurality, and the plurality of locking ribs may include a first locking rib protruding from one side of the crevice tool, and a second locking rib protruding from another side of the crevice tool in an opposite direction to the first locking rib. The stopper may be provided in plurality, and the plurality of stoppers may include a first stopper formed on one end of the first locking rib, and a second stopper formed on one end of the second locking rib. A straight-line distance between an outermost portion of the first stopper and an outermost portion of the second stopper may be longer than a straight-line distance between two protrusions facing each other.

According to the present disclosure having the configuration, a filter assembly can be detached from inside of a dust canister by using a crevice tool without touching the filter assembly by hand.

In addition, the filter assembly can be assembled to the inside of the dust canister using the crevice tool without touching the filter assembly by hand.

This configuration may allow a mesh filter included in the filter assembly to be hygienically washed.

DETAILED DESCRIPTION

Hereinafter, a cleaner according to the present disclosure will be described in detail with reference to the accompanying drawings. A singular representation may include a plural representation unless it represents a definitely different meaning from the context.

Figure 1:
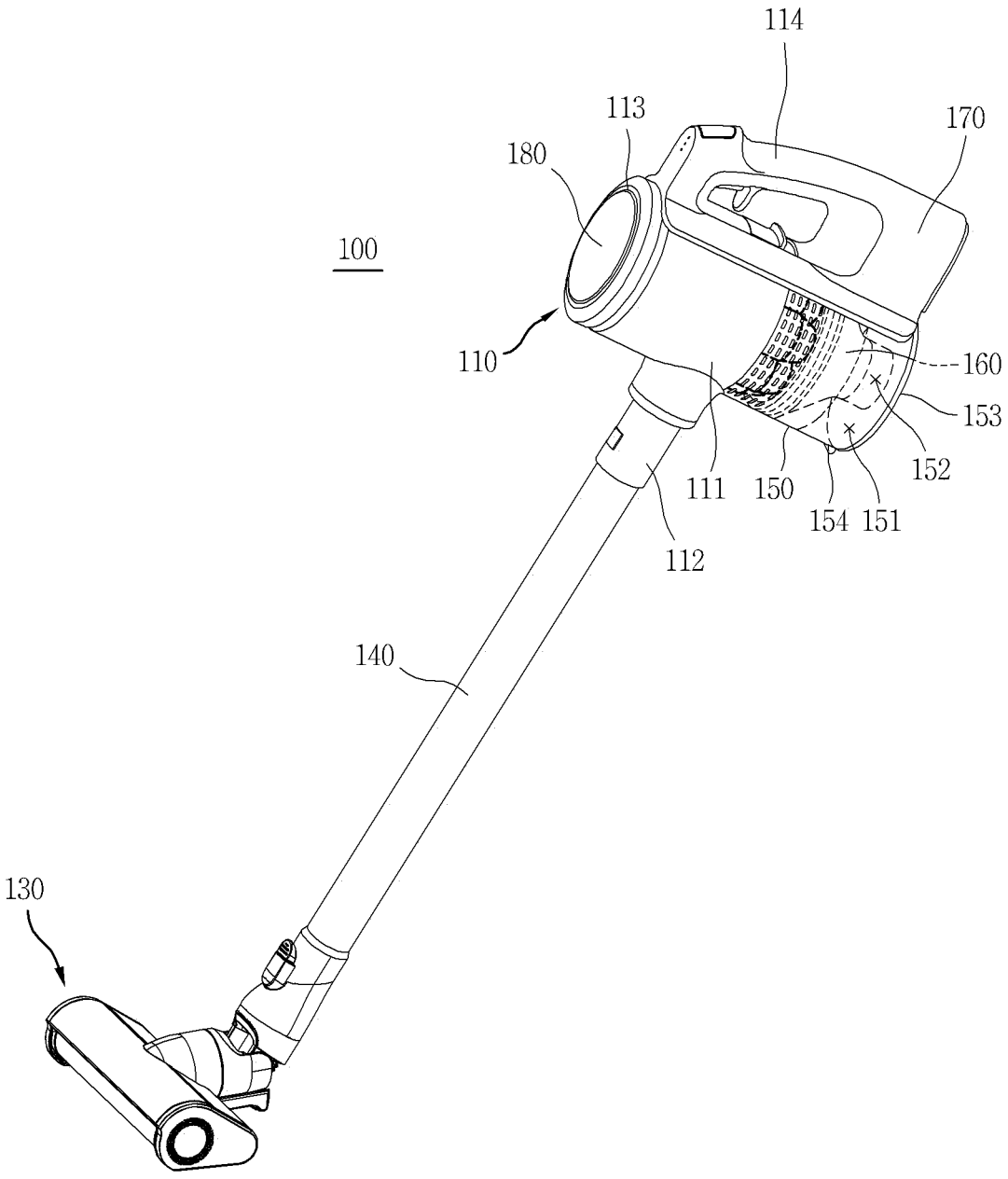
FIG. 1 is a perspective view of a cleaner in accordance with one embodiment of the present disclosure.
Figure 2:
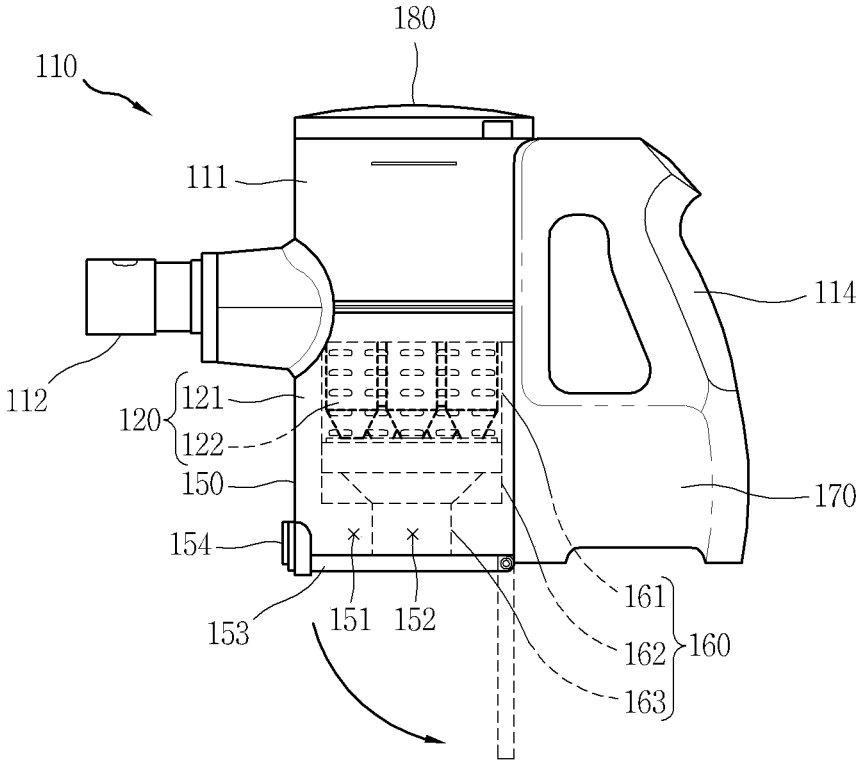
FIG. 2 is a conceptual view of a body.

FIG. 1 is a perspective view of a cleaner 100 in accordance with one embodiment of the present disclosure. FIG. 2 is a conceptual view of a body 110.

The cleaner 100 includes a body 110, a suction nozzle 1340, and an extension pipe 140.

Appearance of the body 110 is defined by a case 111. A plurality of components constructing the cleaner 100 are mounted inside the case 111.

The body 110 includes therein a suction motor (not illustrated). The suction motor is configured to generate a suction force for sucking or suctioning air and dust. The suction force generated by the suction motor is transmitted to the suction nozzle 130 through the extension pipe 140, and the air sucked through the suction nozzle 130 is introduced into the body 110 through the extension pipe 140 and an air entrance 112.

A primary cyclone part 121 and a secondary cyclone part 122 may be disposed inside the body 110. The primary cyclone part 121 and the secondary cyclone part 122 are configured to form a swirl flow in the flow of air. Due to a difference in weight between air and dust, a difference in centrifugal force between the air and the dust is generated, and the difference in the centrifugal force is used to separate the dust from the air.

The primary cyclone part 121 is formed by the case 111 defining the appearance of the body 110 and a filter assembly 160 mounted inside the case 111. The secondary cyclone part 122 is disposed inside the filter assembly 160. The secondary cyclone part 122 is formed by a collection of cyclones. Relatively large dust is separated in the primary cyclone part 121, and relatively small dust is separated in the secondary cyclone part 122.

The body 110 is provided with a dust canister 150. The dust canister 150 may be formed of a transparent material so that an amount of dust collected therein can be viewed from outside. The dust canister 150 is configured to collect therein dust separated from air by the primary cyclone part 121 and the secondary cyclone part 122. The dust canister 150 may be divided into two parts.

A first dust collecting part 151 is configured to collect therein dust separated from air by the primary cyclone part 121. A second dust collecting part 152 is configured to collect therein dust separated from air by the secondary cyclone part 122. The second dust collecting part 152 may be disposed inside the first dust collecting part 151, and the first dust collecting part 151 may be formed in an annular shape surrounding the second dust collecting part 152.

Air separated from dust is discharged to outside of the body 110 through an air exit 113 formed through a filter device 180.

A cover 153 is provided on a bottom of the dust canister 150. The cover 153 defines a bottom of the first dust collecting part 151 and the second dust collecting part 152. The cover 153 is rotatably coupled to the body 110 to open and close the dust canister 150. When a button 154 locking the cover 153 is pressed, the cover 153 is rotated centering on a hinge as a rotational shaft so as to open the dust canister 150. When the dust canister 150 is opened, the dust collected in the first dust collecting part 151 and the dust collected in the second dust collecting part 152 can be discharged at once.

The filter assembly 160 is exposed when the dust canister 150 is opened as the cover 153 is rotated. The filter assembly 160 is mounted inside the dust canister 150 to be exposed when the cover 153 is opened. The filter assembly 160 is configured to filter dust from air flowing along an inner flow path of the body 110. Here, the inner flow path of the body 110 refers to a flow path connecting the primary cyclone part 121 and the secondary cyclone part 122. The filter assembly 160 includes a mesh filter 161, a skirt 162, and a dust collecting part boundary 163.

The mesh filter 161 may be formed in a cylindrical shape surrounding the secondary cyclone part 122. A plurality of holes is formed through the mesh filter 161 so as to filter dust or foreign materials having larger sizes than the holes. The mesh filter 161 is installed at a boundary between the primary cyclone part 121 and the secondary cyclone part 122, to filter dust or foreign materials from air which flows from the primary cyclone part 121 to the secondary cyclone part 122 along the inner flow path of the body 110.

The skirt 162 may be disposed on a bottom of the mesh filter 161. The mesh filter 161 is configured to prevent scattering of dust, which is separated by the primary cyclone part 121 and collected in the first dust collecting part 151. The skirt 162 may extend downward along a circumference and may extend in a longitudinal direction or in an inclined direction.

The dust collecting part boundary 163 defines a boundary between the first dust collecting part 151 and the second dust collecting part 152. The dust collecting part boundary 163 may have a cylindrical shape, and may be formed to has a gradually increased circumference from bottom to top. A curved surface or an inclined surface may be formed in a region where the circumference is increased, to induce smooth collection of dust falling from the secondary cyclone part 122.

A battery 170 may be provided inside the body 110. The battery 170 may be detachably mounted in the body 110. The battery 170 is configured to supply power to the suction motor or the like. The suction nozzle 130 may be provided with a rotary cleaning member, and the battery 170 may also supply power to the rotary cleaning member.

A handle 114 which the user grips may be provided on an outer surface of body 110. The user can perform cleaning while gripping the handle 114.

Referring to FIG. 1, the suction nozzle 130 suctions air and dust in a region to be cleaned (cleaning region) by using a suction force transmitted from the suction motor. The suction nozzle 130 may be provided with a rotary cleaning member, and the rotary cleaning member rotates inside the suction nozzle 130 to sweep the dust on the cleaning region to be sucked into the suction nozzle 130.

A filter device 180 is disposed on a top of the body 110. The filter device 180 is coupled to an upper end of the case 111 to finally filter fine dust or ultrafine dust from air filtered by the secondary cyclone part 122. An air exit 113 is formed through the filter device 180.

An extension pipe 140 connects the body 110 to the suction nozzle 130. The extension pipe 140 may extend or contract along a lengthwise direction. The suction nozzle 130 is detachably coupled to the extension pipe 140. The suction nozzle 130 may alternatively be directly connected to the air entrance 112 of the body 110 without the extension pipe 140.

The cleaner 100 may include various cleaning tools that can be replaced with the suction nozzle 130. For example, any one of a brush tool, a mop tool, a bedding tool, and a crevice tool 190 may be replaced with the suction nozzle 130. These cleaning tools are configured to be coupled to the air entrance 112 or extension pipe 140 of the body 110.

The brush tool is provided with a brush on a portion which is brought into contact with a floor (bottom), so as to clean the floor while sweeping a lot of dust. The mop tool is provided with a mop and may mop the floor by rotation of the mop. The bedding tool is provided with a beat member that beats bedding, and the beat member may beat the bedding during air suction, so as to remove dust from the bedding. The crevice tool 190 (refer to FIG. 4A) has a relatively narrow intake port, and can clean dust which exists in a narrow space.

As the cleaner 100 is operated for an extended time, dust is accumulated not only in the dust canister 150 but also on the filter assembly 160. In particular, dust is accumulated even on the mesh filter since dust is filtered between the primary cyclone part 121 and the secondary cyclone part 122. If trying to remove dust by putting a hand inside after opening the cover 153, the dust may make the hand dirty and even cannot be sufficiently removed.

Therefore, in order to reliably remove the dust accumulated in the filter assembly 160, the filter assembly 160 is preferably washed by being separated from the body 110. However, when the hand is used in the process of separating the filter assembly 160 from the body 110, the dust accumulated on the filter assembly 160 may be transferred to the hand or scattered.

Accordingly, the present disclosure proposes a structure of a dust collecting part boundary 163 and the crevice tool 190, by which the filter assembly 160 can be detached from the body 110 without gripping the filter assembly by hand. This structure will be described with reference to the accompanying drawings, starting from FIG. 3A.

Figure 3A:
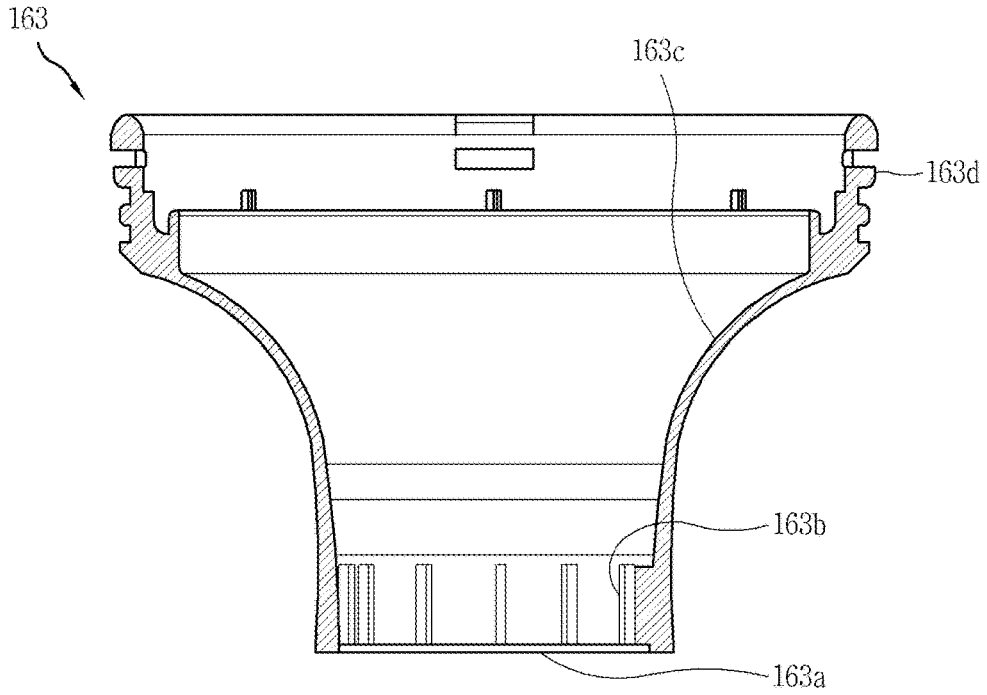
FIG. 3A is a cross-sectional view illustrating a dust collecting part boundary of a filter assembly.
Figure 3B:
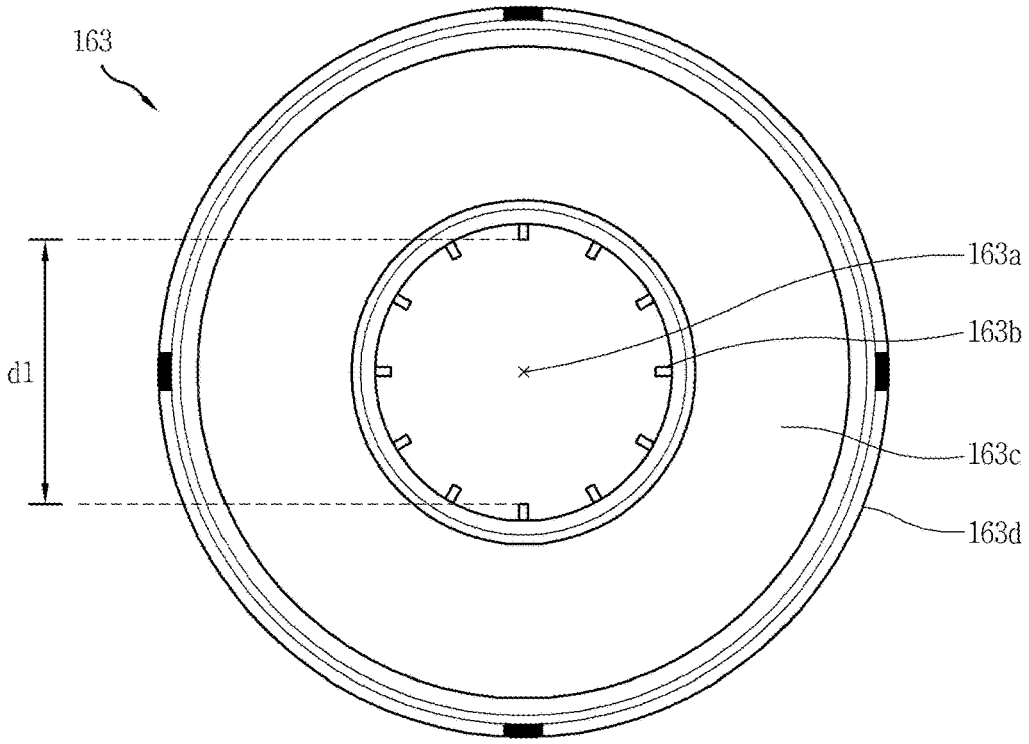
FIG. 3B is a planar view illustrating the dust collecting part boundary of the filter assembly.

FIG. 3A is a cross-sectional view illustrating the dust collecting part boundary 163 of the filter assembly 160. FIG. 3B is a planar view of the dust collecting part boundary 163 of the filter assembly 160.

The dust collecting part boundary 163, as aforementioned, defines the boundary between the first dust collecting part 151 and the second dust collecting part 152. A lower end portion of the dust collecting part boundary 163 is formed in a cylindrical shape, and an inner diameter of the cylinder gradually increases toward an upper end. A curved surface 163*c* or an inclined surface may be formed, as illustrated in FIG. 3, in a region where the inner diameter is increased.

An outer side of the dust collecting part boundary 163 corresponds to the first dust collecting part 151. Dust separated from air by the primary cyclone part 121 is collected in the first dust collecting part 151. An annular space formed between the upper end of the dust collecting part boundary 163 and the case 111 is relatively narrow, but an annular space formed between the lower end of the dust collecting part boundary 163 and the case 111 is relatively large. Therefore, a space for the first dust collecting part 151 may be secured between the lower end of the dust collecting part boundary 163 and the case 111.

An inner side of the dust collecting part boundary 163 corresponds to the second dust collecting part 152. Dust separated from air by the secondary cyclone part 122 is collected in the second dust collecting part 152. Since the curved surface 163*c* or the inclined surface is formed between the upper end and the lower end of the dust collecting part boundary 163, dust falling from the secondary cyclone part 122 may be collected in the second duct collecting part 152 along the curved surface 163*c* or the inclined surface.

A groove 163*d* to which the skirt 162 can be coupled is formed in the upper end of the dust collecting part boundary 163. At least portion of the skirt 162 may protrude to be inserted into the groove 163*d*, so that the dust collecting part boundary 163 and the skirt 162 can be coupled to each other. The skirt 162 may be fixed to the dust collecting part boundary 163 or may be coupled to be rotatable relative to the dust collecting part boundary 163.

Among those components constructing the filter assembly 160, the dust collecting part boundary 163 is disposed at the lowermost position. Therefore, when the cover 153 is opened, one end (lower end) of the dust collecting part boundary 163 is exposed. Looking at the dust collecting part boundary 163 while the cover 153 is opened, an opening (or opening portion) 163*a* opened toward the cover 153 is formed. A protrusion (or protrusion portion) 163*b* is formed on an inner circumferential surface of the opening 163*a*.

Referring to FIG. 3A, the protrusion 163*b* is provided in plurality, and each of the protrusions 163*b* extends along a direction from the top to the bottom of the filter assembly 160. Referring to FIG. 3B, the plurality of protrusions 163*b* protrudes from the inner circumferential surface of the opening 163*a*. The plurality of protrusions 163*b* is disposed to be spaced apart from one another along the inner circumferential surface (inner circumference) of the opening 163*a*, in a manner that two protrusions 163*b* face each other.

Hereinafter, the crevice tool 190 inserted into the opening 163*a* to withdraw (pull out) the filter assembly 160 will be described.

Figure 4A:
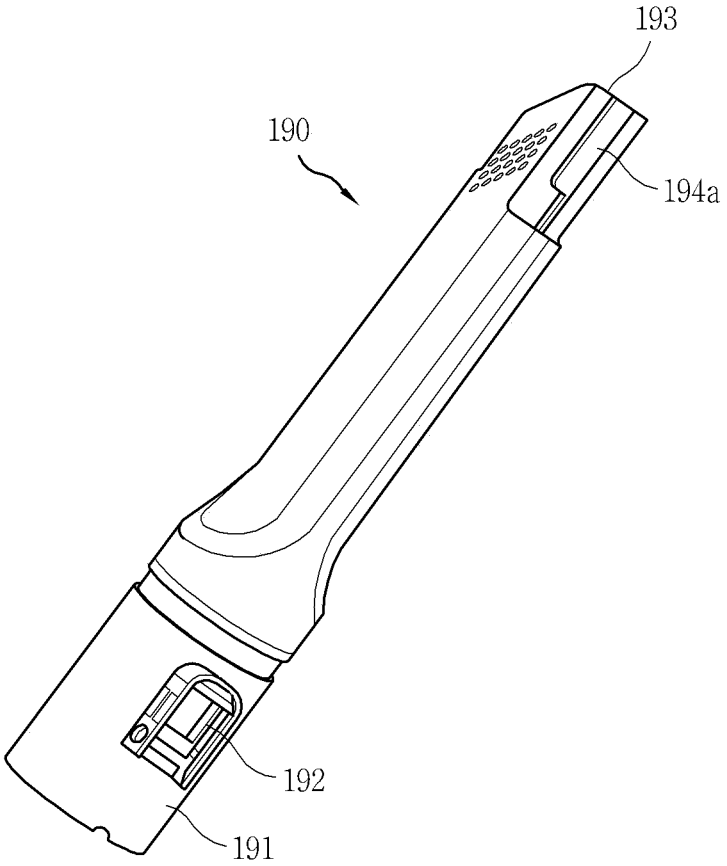
FIG. 4A is a perspective view of a crevice tool.
Figure 4B:
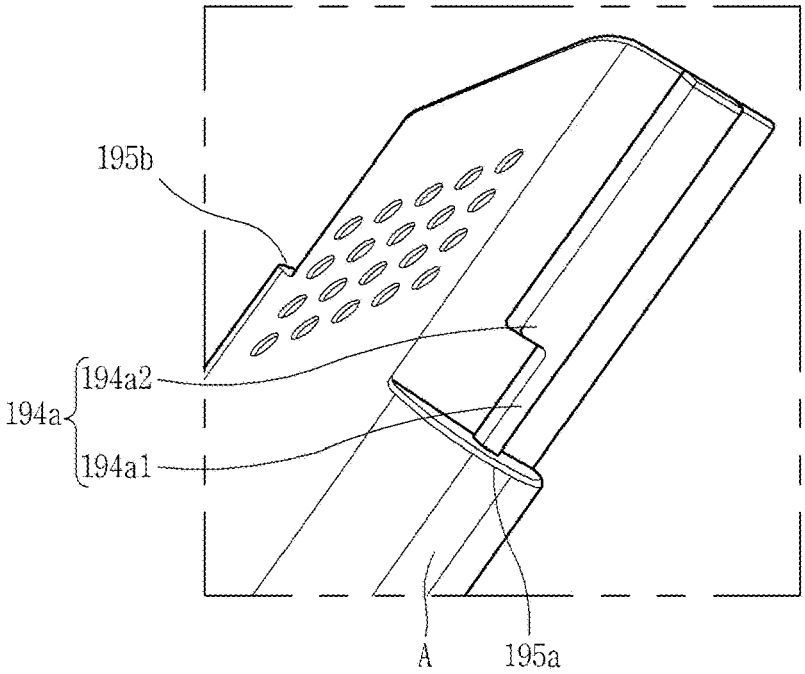
FIG. 4B is an enlarged conceptual view illustrating one side of the crevice tool illustrated in FIG. 4A.
Figure 4C:
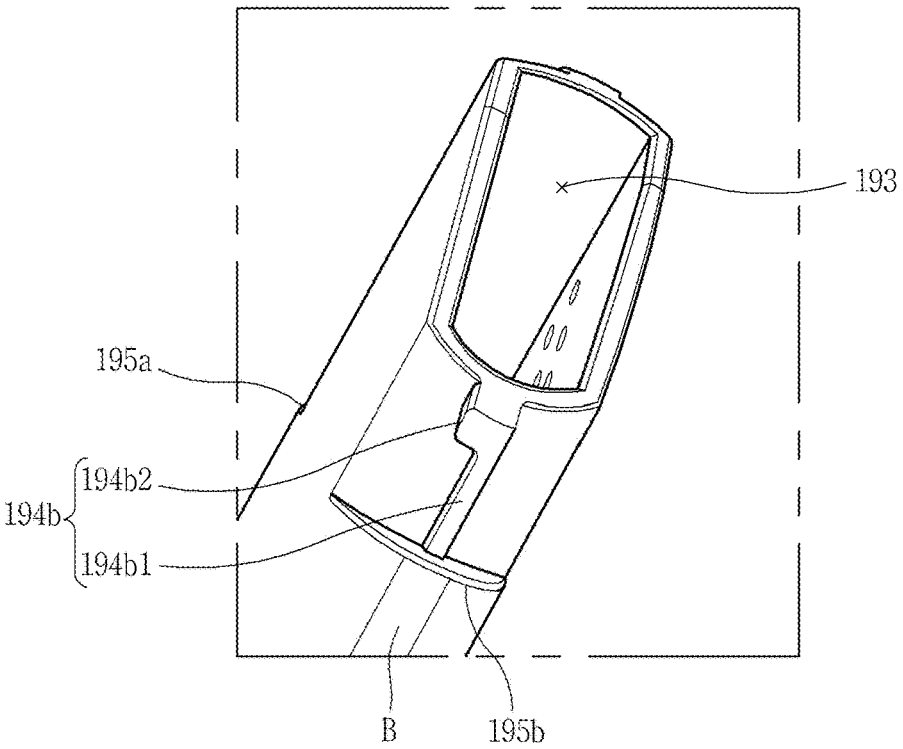
FIG. 4C is an enlarged conceptual view of another side of the crevice tool illustrated in FIG. 4A.

FIG. 4A is a perspective view of the crevice tool 190. FIG. 4B is an enlarged conceptual view illustrating one side of the crevice tool 190 illustrated in FIG. 4A. FIG. 4C is an enlarged conceptual view of another side of the crevice tool 190 illustrated in FIG. 4A.

A connecting portion 191 of the crevice tool 190 may be connectable to the extension pipe 140. For example, the connecting portion 191 is formed in a cylindrical shape, and the extension pipe 140 may be inserted into the cylindrical connecting portion 191. Alternatively, the crevice tool 190 may be directly inserted into the air entrance 112 of the body 110.

The connecting portion 191 may be provided with a button 192 for releasing the coupling with the extension pipe 140 or the air entrance 112. When the crevice tool 190 is pulled out while pressing the button 192, the crevice tool 190 may be separated from the extension pipe 140 or the air entrance 112.

Unlike other components of the cleaner 100, the crevice tool 190 has a narrow intake port 193. The reason why the intake port 193 of the crevice tool 190 is relatively narrow is that the crevice tool 190 is for cleaning a narrow gap or clearance, unlike other cleaning tools.

Both sides of the crevice tool 190 may be partially narrowed from the connecting portion 191 toward the intake port 193, in order to narrow the intake port 193 of the crevice tool 190. A periphery of the intake port 193 may be inclined, and thus even a narrow clearance can be easily cleaned by virtue of the inclined periphery of the intake port 193.

The crevice tool 190 includes locking ribs (or catching ribs) 194*a* and 194*b*. The crevice tool 190 may be inserted into the opening 163*a* of the dust collecting part boundary 163. The locking ribs 194*a* and 194*b* may protrude from an outer surface of the crevice tool 190 to be caught on the protrusions 163*b* as the crevice tool 190 is inserted into the opening 163*a* and rotated.

The locking ribs 194*a* and 194*b* protrude from both sides of the crevice tool 190. The first locking rib 194*a* protrudes from one side of the crevice tool 190. The second locking rib 194*b* protrudes from another side of the crevice tool 190 in an opposite direction of the first locking rib 194*a*.

One of the first locking rib 194*a* and the second locking rib 194*b* may have a longer length than the other. This is because the periphery of the intake port 193 is inclined. The first locking rib 194*a* illustrated in FIG. 4A is shown having a longer length than the second locking rib 194*b* illustrated in FIG. 4B. However, the lengths of the first locking rib 194*a* and the second locking rib 194*b* are not necessarily different from each other.

The first locking rib 194*a* and the second locking rib 194*b* each include a position setting portion 194*a*1, 194*b*1 and a locking portion 194*a*2, 194*b*2. The position setting portion 194*a*1, 194*b*1 may be referred to as a first portion, and the locking portion 194*a*2, 194*b*2 may be referred to as a second portion.

The position setting portion 194*a*1, 194*b*1 extends along a lengthwise direction of the crevice tool 190. Since the crevice tool 190 is inserted and drawn out along the lengthwise direction, it may be understood that the position setting portion 194*a*1, 194*b*1 extends along the direction that the crevice tool 190 is inserted and drawn out. An extending direction of the protrusions 163*b* formed in the opening 163*a* of the dust collecting part boundary 163 and an extending direction of the position setting portion 194*a*1, 194*b*1 are substantially in parallel to each other.

The position setting portion 194*a*1 of the first locking rib 194*a* and the position setting portion 194*b*1 of the second locking rib 194*b* preferably have substantially the same length as each other. This is because the first locking rib 194*a* and the second locking rib 194*b* can be caught on any protrusion 163*b* of the dust collecting part boundary 163.

The locking portions 194*a*2 and 194*b*2 extend in an intersecting direction with the position setting portions 194*a*1 and 194*b*1. The position setting portions 194*a*1 and 194*b*1 and the locking portions 194*a*2 and 194*b*2 may be orthogonal to each other. Therefore, when the crevice tool 190 is inserted into the opening 163*a* of the dust collecting part boundary 163 and rotated, the locking portions 194*a*2 and 194*b*2 are caught on the protrusions 163*b*. In this state, the crevice tool 190 is not separated arbitrarily unless the crevice tool 190 is reversely rotated.

The crevice tool 190 includes stoppers 195*a* and 195*b* formed on one end of the first locking rib 194*a* and one end of the second locking rib 194*b*, respectively. The stoppers 195*a* and 195*b* are formed on one end of the position setting portion 194*a*1 and one end of the position setting portion 194*b*1 (lower ends of the position setting portions 194*a*1 and 194*b*1 in FIGS. 4A and 4B). Therefore, it can be understood that the locking portions 194*a*2 and 194*b*2 are formed on another ends of the position setting portions 194*a*1 and 194*b*1, respectively.

The stoppers 195*a* and 195*b* are formed to set an insertion length of the crevice tool 190. The locking ribs 194*a* and 194*b* must be inserted between the two neighboring protrusions 163*b* in order to be caught on the protrusions 163*b*. Therefore, if there are no stoppers 195*a* and 195*b*, the insertion length of the crevice tool 190 may not be accurately determined and the crevice tool 190 may be continuously inserted until reaching the secondary cyclone part 122.

The stoppers 195*a* and 195*b* protrude from an outer surface of the crevice tool 190. The stoppers 195*a* and 195*b* protrude more than the locking ribs 194*a* and 194*b* to set the insertion length of the crevice tool 190. The first stopper 195*a* protrudes from one side of the crevice tool 190 and is formed on one end (lower end in FIGS. 4A and 4B) of the first locking rib 194*a*. The second stopper 195*b* protrudes from another side of the crevice tool 190 and is formed on one end (lower end in FIGS. 4A and 4B) of the second locking rib 194*b*.

A straight-line distance between an outermost part A of the first stopper 195*a* and an outermost part B of the second stopper 195*b* is longer than a straight-line distance dl (see FIG. 3B) between the two protrusions 163*b* facing each other. Thus, further insertion of the crevice tool 190 can be restricted by the stoppers 195*a* and 195*b*, and the insertion length of the crevice tool 190 can be set thusly.

Hereinafter, a process of separating the filter assembly 160 from the body 110 by coupling the crevice tool 190 to the filter assembly 160 will be described.

Figure 5A:
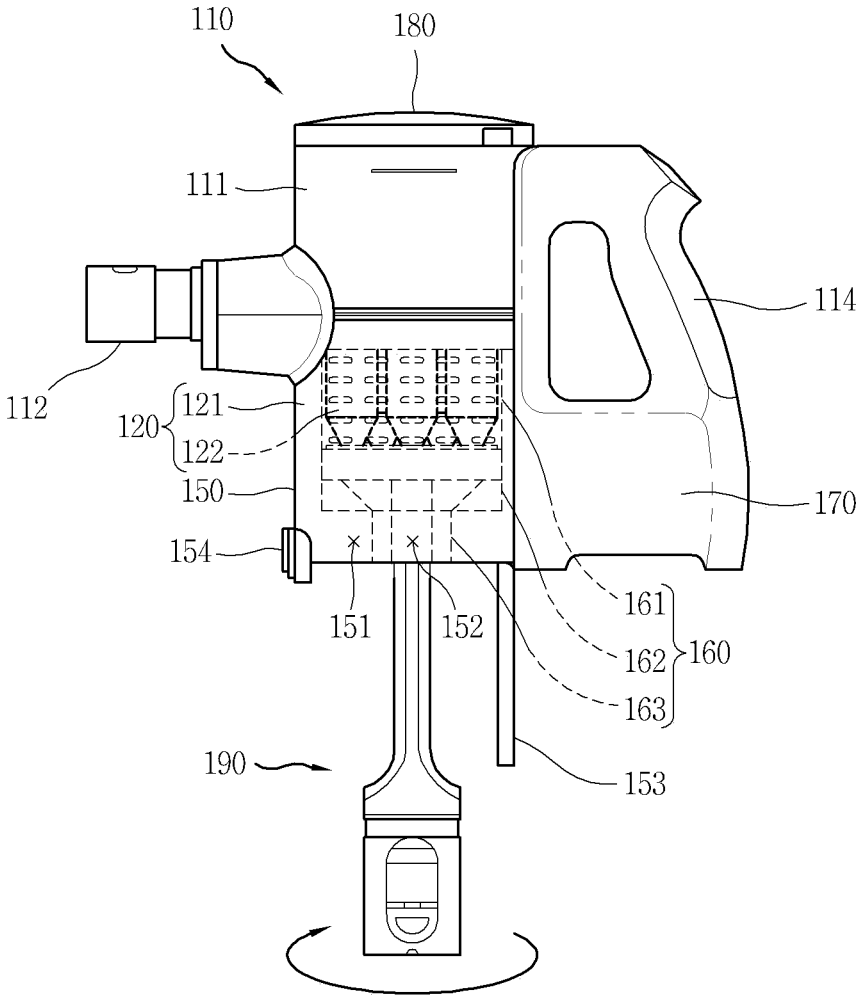
FIG. 5A is a conceptual view illustrating a process of coupling the crevice tool to the filter assembly.
Figure 5B:
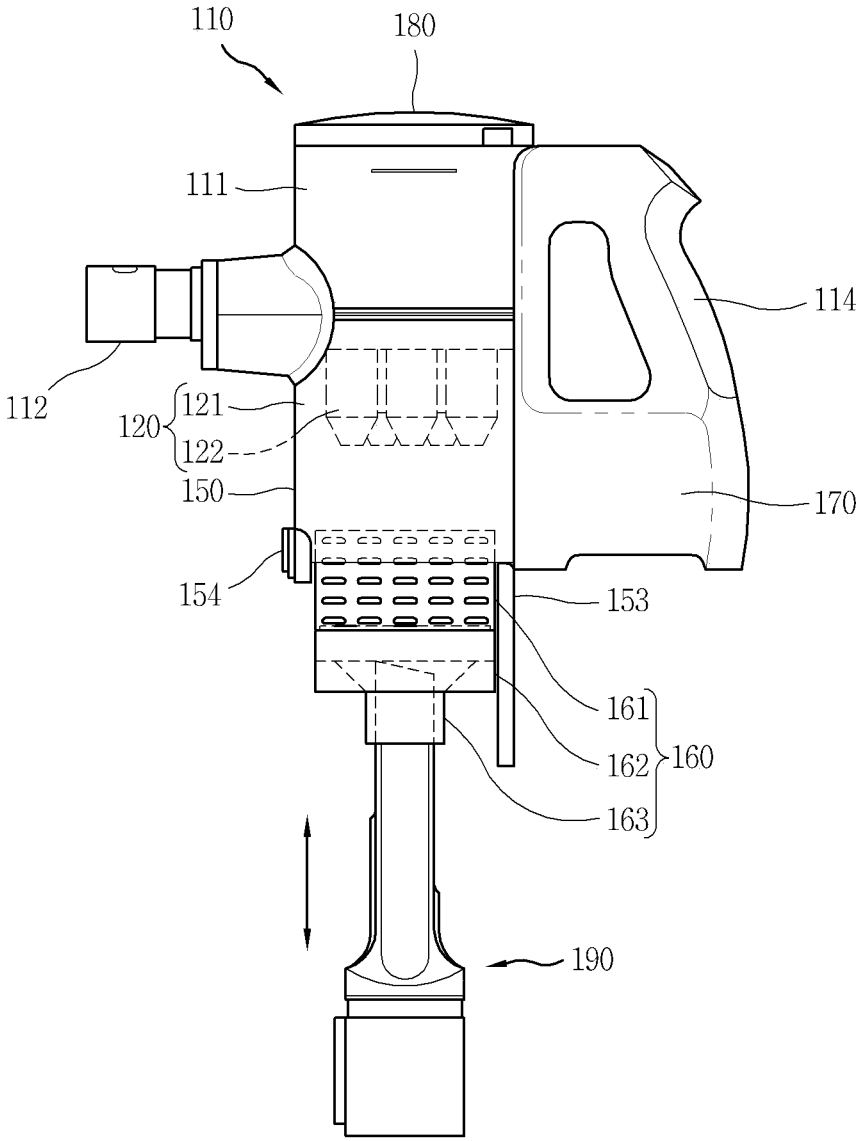
FIG. 5B is a conceptual view illustrating a process of separating the filter assembly from the body using the crevice tool.

FIG. 5A is a conceptual view illustrating a process of coupling the crevice tool 190 to the filter assembly 160. FIG. 5B is a conceptual view illustrating a process of separating the filter assembly 160 from the body 110 using the crevice tool 190.

When the intake port 193 of the crevice tool 190 is pushed into the body 110 while the cover 153 for opening and closing the dust canister 150 is opened, the crevice tool 190 is inserted into the opening 163*a* of the dust collecting part boundary 163. Since the stoppers 195*a* and 195*b* set the insertion length of the crevice tool 190, the crevice tool 190 can be inserted until the stoppers 195*a* and 195*b* are stopped by the protrusions 163*b*.

When the crevice tool 190 is rotated in a completely inserted state, the locking ribs 194*a* and 194*b* of the crevice tool 190 are caught on the protrusions 163*b* of the dust collecting part boundary 163. When the crevice tool 190 is further rotated while the locking ribs 194*a* and 194*b* are caught on the protrusions 163*b*, the filter assembly 160 is released from the inside of the dust canister 150.

The mesh filter 161 includes a protrusion 161*a* on an outer side thereof, and a locking rib 155 is formed on an inner side of the body 110. When the protrusion 161*a* of the mesh filter 161 is locked by the locking rib 155 of the body 110, an arbitrary separation of the filter assembly 160 is restricted. On the contrary, when the protrusion 161*a* of the mesh filter 161 is released from the locking rib 155 of the body 110, the filter assembly 160 can be detached from the body 110. The protrusion 161*a* of the mesh filter 161 and the locking rib 155 of the body 110 will be described with reference to FIGS. 6A and 6B.

In the state where the locking ribs 194*a* and 194*b* are locked by the protrusions 163*b* and the filter assembly 160 is unlocked from the inside of the body 110, when the crevice tool 190 is pulled out of the dust canister 150, the filter assembly 160 is also drawn out of the dust canister 150 together with the crevice tool 190 by a force for pulling the crevice tool 190 from the opening 163*a*. Through this process, the filter assembly 160 can be detached from the body 110 without touching the filter assembly 160 by hand.

Since the dust canister 150 constitutes a part of the body 110, detaching (separating) the filter assembly 160 from the inside of the body 110 is substantially the same meaning as detaching (separating) the filter assembly 160 from the inside of the dust canister 150.

Hereinafter, changes in relative positions of the locking ribs 194*a* and 194*b* and the protrusions 163*b* during the process of detaching or attaching the filter assembly 160 using the crevice tool 190 will be described.

FIGS. 6A to 6E are conceptual views illustrating relative positions of the locking rib and protrusions 163*b*1 and 163*b*2 during the process of coupling the crevice tool 190 to the filter assembly 160. The description will be made based on the second locking rib 194*b*, but the same description may be applied to the first locking rib 194*a*.

Figure 6A:
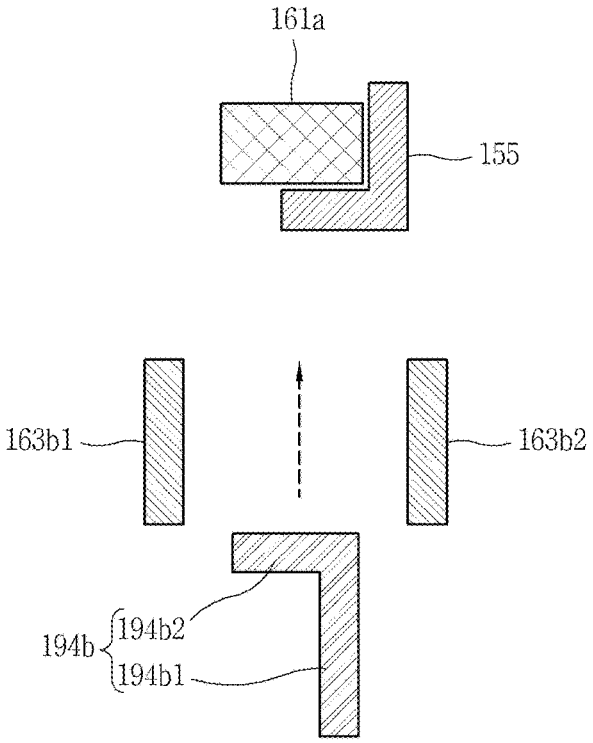
FIGS. 6A to 6E are conceptual views illustrating relative positions of a locking rib and protrusions during the process of coupling the crevice tool to the filter assembly.

Referring first to FIG. 6A, the second locking rib 194*b* is inserted between two protrusions 163*b*1 and 163*b*2 by the insertion of the crevice tool 190.

Figure 6B:
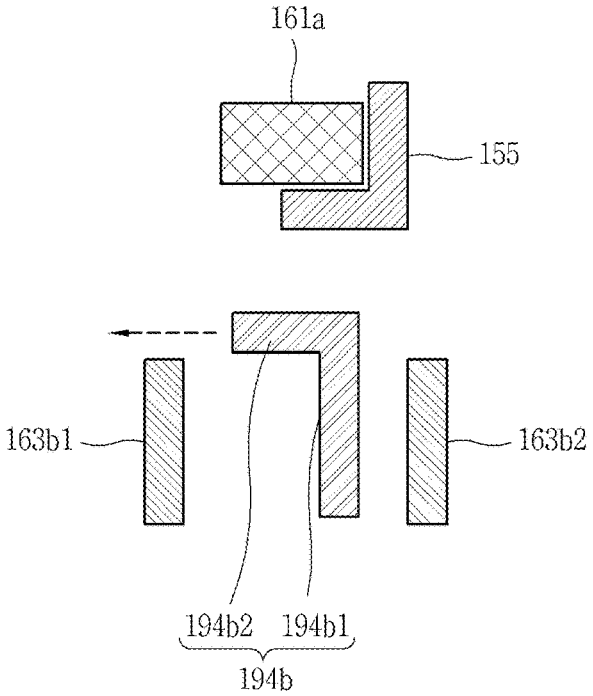

Subsequently, referring to FIG. 6B, the second locking rib 194*b* is locked on the left protrusion 163*b*1 of the two protrusions 163*b*1 and 163*b*2, by the rotation of the crevice tool 190 in a first direction (a left direction in FIG. 6A). Here, the first direction corresponds to a direction in which the locking portion 194*b*2 of the second locking rib 194*b* is locked on the left protrusion 163*b*1. The position setting portion 194*b*1 is brought into close contact with the left protrusion 163*b*1 by the rotation of the crevice tool 190 in the first direction so as to set a locking position of the second locking rib 194*b*.

Figure 6C:
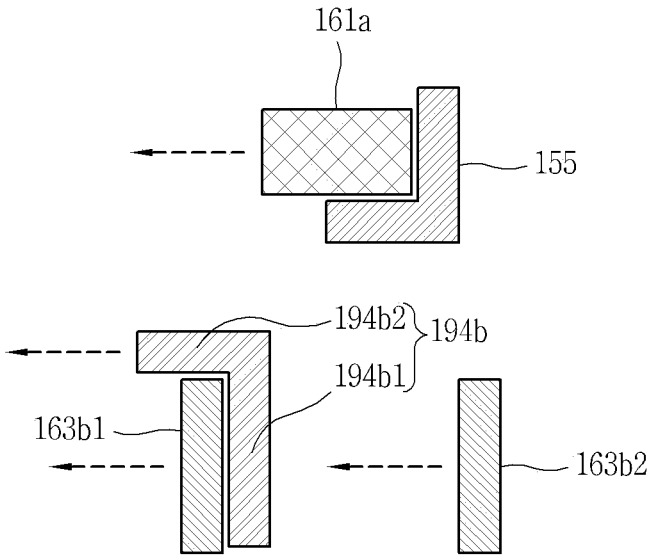

Next, referring to FIG. 6C, after the position setting portion 194*b*1 is brought into close contact with the left protrusion 163*b*1, the filter assembly 160 is rotated together with the crevice tool 190 by a force applied further toward the first direction. As the filter assembly 160 is rotated in the first direction, the protrusion 161*a* of the mesh filter 161 is released from the locking rib 155 of the body 110. And the filter assembly 160 is in a state capable of being detached from the inside of the body 110.

Figure 6D:
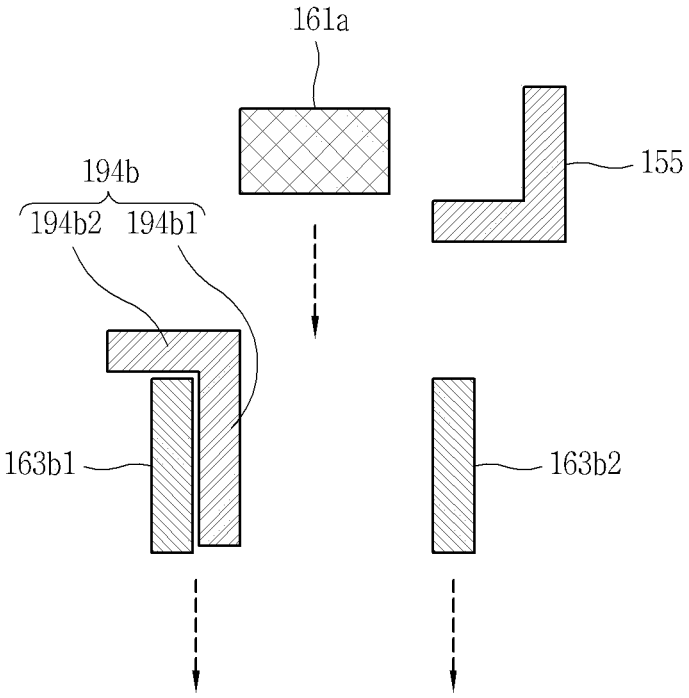

Continuously, referring to FIG. 6D, the filter assembly 160 is also taken out of the dust canister 150 together with the crevice tool 190 by a force applied to pull the crevice tool 190 out of the dust canister 150. Since the locking portion 194*b*2 of the second locking rib 194*b* is locked on the left protrusion 163*b*1, the dust collecting part boundary 163 is also taken out together with the crevice tool 190. Since the mesh filter 161 and the skirt 162 are coupled to the dust collecting part boundary 163, the mesh filter 161 and the skirt 162 are also drawn out of the dust canister 150 together with the dust collecting part boundary 163.

Figure 6E:
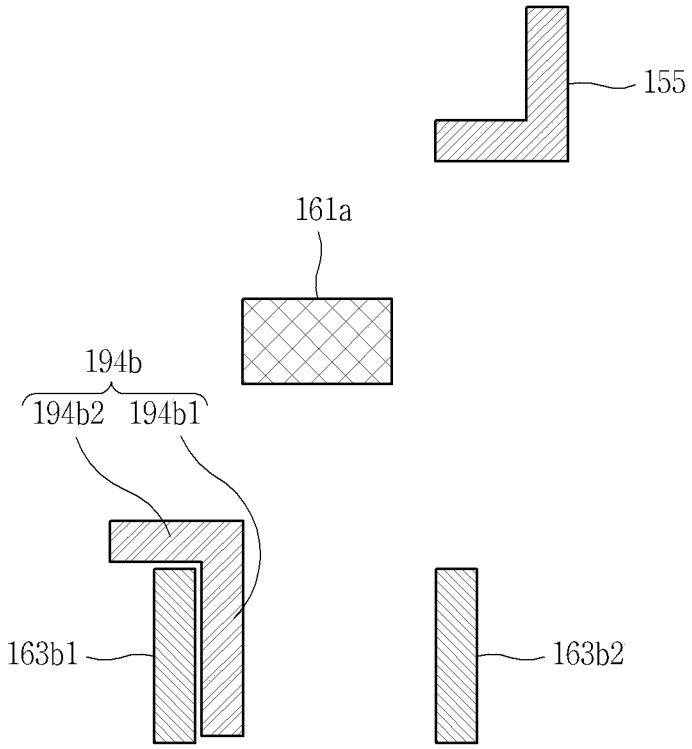

Finally, referring to FIG. 6E, it can be seen that the protrusion 161*a* of the mesh filter 161 has been released from the locking rib 155 of the body 1109 and then moved out of the dust canister 150. Therefore, it can be seen that the filter assembly 160 has been drawn out of the dust canister 150.

FIGS. 7A to 7E are conceptual views illustrating relative positions of the locking rib and the protrusions 163*b*1 and 163*b*2 during the process of detaching the crevice tool 190 from the filter assembly 160.

Figure 7A:
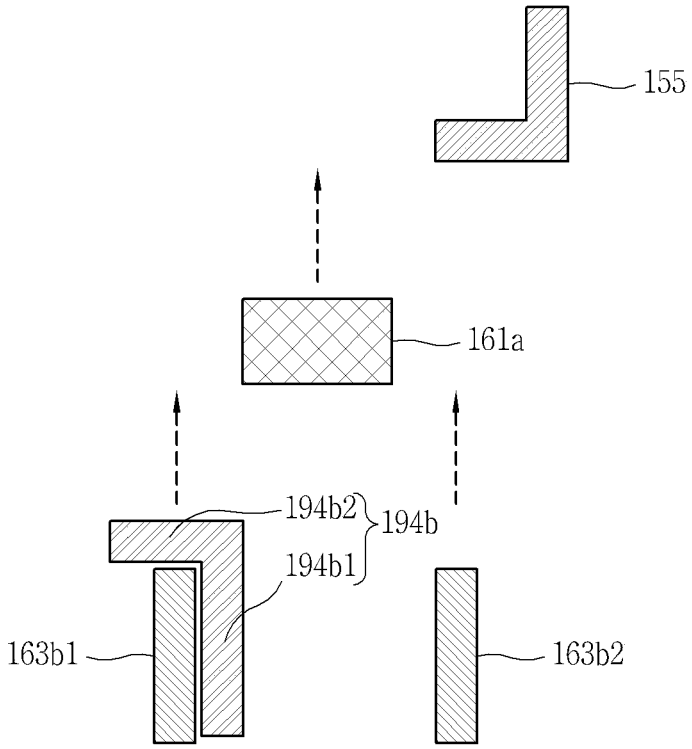
FIGS. 7A to 7E are conceptual views illustrating relative positions of the locking rib and the protrusions during the process of separating the crevice tool from the filter assembly.

First, referring to FIG. 7A, the protrusions 163*b*1 and 163*b*2 of the dust collecting part boundary 163, the second locking rib 194*b* of the crevice tool 190, and the protrusion 161*a* of the mesh filter 161 are inserted together into the dust canister 150. A force for inserting the crevice tool 190 into the dust canister 150 is also transferred to the protrusions 163*b*1 and 163*b*2 through the stoppers 195*a* and 195*b*. Therefore, the filter assembly 160 is also inserted into the dust canister 150 together with the crevice tool 190 by the force of inserting the crevice tool 190 into the dust canister 150.

Figure 7B:
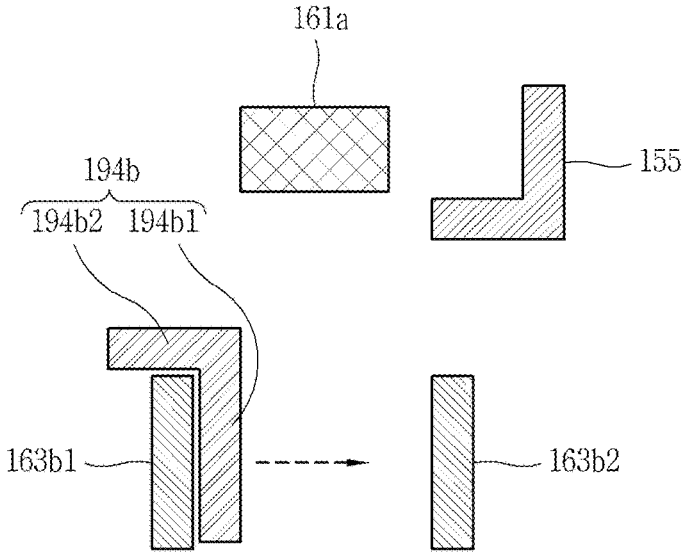

Next, referring to FIG. 7B, the second locking rib 194*b* of the crevice tool 190 and the protrusion 161*a* of the mesh filter 161 are rotated in a second direction (a right direction in FIG. 7A). The second direction is a direction in which the locking portion 194*b*2 is released from the left protrusion 163*b*1. The position setting portion 194*b*1 is brought into close contact with the right protrusion 163*b*2 by the rotation of the crevice tool 190 in the second direction so as to set a release position of the second locking rib 194*b*.

Figure 7C:
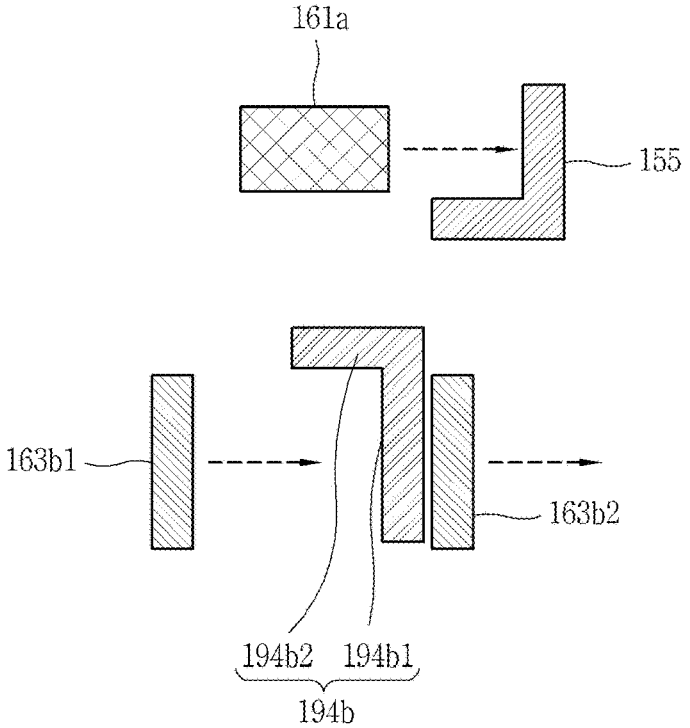

Subsequently, referring to FIG. 7C, the protrusions 163*b*1 and 163*b*2 of the dust collecting part boundary 163 and the protrusion 161*a* of the mesh filter 161 are rotated in the second direction by a force further applied in the second direction after the position setting portion 194*b*1 is brought into close contact with the right protrusion 163*b*2.

Figure 7D:
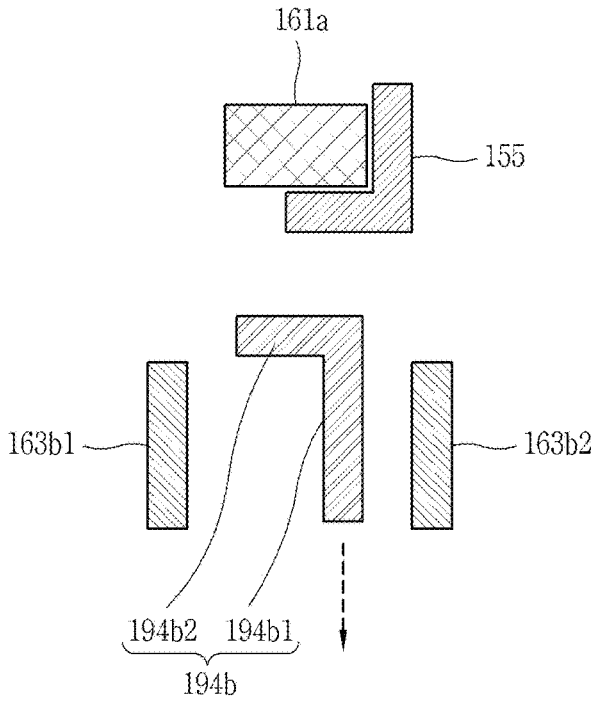

Continuously, referring to FIG. 7D, the protrusion 161*a* of the mesh filter 161 is locking on the locking rib 155 of the body 110. The filter assembly 160 is coupled to the inside of the dust canister 150 as it rotates in the second direction.

Figure 7E:
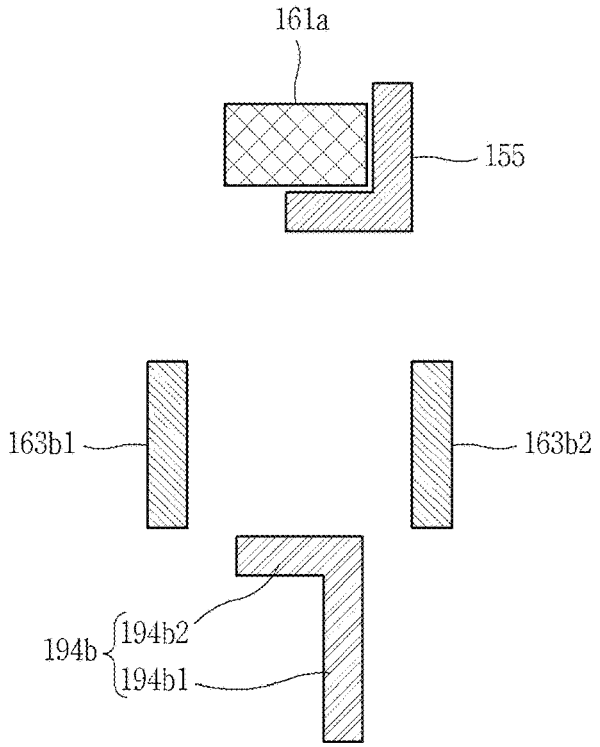

Finally, referring to FIG. 7E, the second locking rib 194*b* of the crevice tool 190 is released from the protrusion 161*a* of the filter assembly 160. Accordingly, only the crevice tool 190 can be drawn out.

The cleaner described above is not limited to the configurations and the methods of the embodiments described above, but the embodiments may be configured by selectively combining all or part of the embodiments so that various modifications or changes can be made.

The present disclosure can be used in an industrial field related to a cleaner.

What is claimed is:

1. A cleaner comprising:

a dust canister provided in a body and configured to collect dust therein;

a cover rotatably coupled to the body to open and close the dust canister;

a filter assembly mounted inside the dust canister to be exposed when the cover is opened, and configured to filter dust from air flowing along an inner flow path of the body; and a crevice tool connectable to an air entrance of the body or an extension pipe connected to the air entrance, wherein the filter assembly comprises:

an opening opened toward the cover; and a protrusion protruding from an inner circumferential surface of the opening, the crevice tool comprises a locking rib caught on the protrusion as the crevice tool is inserted into the opening and rotated, and the filter assembly is drawn out of the dust canister together with the crevice tool by a force for pulling the crevice tool out of the dust canister while the locking rib is locked on the protrusion wherein the locking rib comprises:

a position setting portion extending along a direction that the crevice tool is inserted and drawn out; and a locking portion extending in a direction intersecting with the position setting portion and locked on one of two protrusions.

2. The cleaner of claim 1, wherein the protrusion is provided in plurality, spaced apart from one another along the inner circumferential surface of the opening, and the locking rib is inserted between two neighboring protrusions by the insertion of the crevice tool, and locked on one of the two neighboring protrusions by rotation of the crevice tool.

3. The cleaner of claim 1, wherein the crevice tool is rotatable in a first direction and a second direction opposite to each other in a state where the crevice tool is inserted into the opening, and the first direction corresponds to a direction in which the locking portion is locked on one of the two protrusions, and the second direction corresponds to a direction in which the locking portion is released from the one of the two protrusions.

4. The cleaner of claim 3, wherein the position setting portion is brought into close contact with the one of the two protrusions by the rotation of the crevice tool in the first direction so as to set a locking position of the locking rib, and the position setting portion is brought into close contact with another one of the two protrusions by the rotation of the crevice tool in the second direction so as to set an unlocking position of the locking rib.

5. The cleaner of claim 4, wherein the filter assembly is rotated in the first direction by a force applied further toward the first direction after the position setting portion is brought into close contact with the one of the two protrusions, and the filter assembly is rotated in the second direction by a force applied further toward the second direction after the position setting portion is brought into close contact with the another one of the two protrusions.

6. The cleaner of claim 4, wherein the filter assembly is detached from an inside of the dust canister by the rotation in the first direction, and is attached to the inside of the dust canister by the rotation in the second direction.

7. The cleaner of claim 1, wherein the crevice tool comprises a stopper formed on one end of the locking rib, and the stopper protrudes from an outer side of the crevice tool and protrudes more than the locking rib to set an insertion length of the crevice tool.

8. The cleaner of claim 7, wherein the protrusion is provided in plurality, arranged along the inner circumferential surface of the opening in a manner that each pair of protrusions faces each other, and the locking rib is one of a plurality of locking ribs comprising:

a first locking rib protruding from one side of the crevice tool; and a second locking rib protruding from another side of the crevice tool in an opposite direction to the first locking rib, the stopper is one of a plurality of stoppers comprising:

a first stopper formed on one end of the first locking rib; and a second stopper formed on one end of the second locking rib, and a straight-line distance between an outermost portion of the first stopper and an outermost portion of the second stopper is longer than a straight-line distance between two protrusions facing each other.

* * * * *